United States Patent [19]

Guadagno

[11] Patent Number: 4,862,807

[45] Date of Patent: Sep. 5, 1989

[54] PASSIVE RAILWAY SWITCHING SYSTEM

[75] Inventor: James R. Guadagno, Denver, Colo.

[73] Assignee: Cimarron Technology Ltd., Ridgway, Colo.

[21] Appl. No.: 115,177

[22] Filed: Oct. 30, 1987

Related U.S. Application Data

[60] Division of Ser. No. 835,974, Mar. 4, 1986, abandoned, which is a continuation-in-part of Ser. No. 513,009, Jul. 12, 1983, abandoned.

[51] Int. Cl.[4] ..... E01B 7/00

[52] U.S. Cl. ..... 104/130; 246/424

[58] Field of Search ..... 104/88, 96, 33, 105, 104/130, 261; 105/157.1, 171, 177, 178, 463.1; 246/415 R, 420, 421, 424, 426, 427, 432, 454, 456, 457, 469

[56] References Cited

U.S. PATENT DOCUMENTS

| | | | |
|---|---|---|---|
| 26,933 | 1/1860 | Shedd et al. | 246/427 X |
| 426,751 | 4/1890 | Appleyard | 246/424 |
| 765,572 | 7/1904 | Fitzgerald | 246/427 |
| 815,666 | 3/1906 | Winchell | 246/424 |
| 3,430,580 | 3/1969 | Edens | 104/96 X |
| 3,774,543 | 11/1973 | Welsh | 104/130 |
| 3,811,383 | 5/1974 | Butzow | 246/427 X |
| 4,005,839 | 2/1977 | Frank | 246/427 X |

FOREIGN PATENT DOCUMENTS

| | | | |
|---|---|---|---|
| 641059 | 6/1962 | Italy | 104/130 |
| 722 | of 1891 | United Kingdom | 246/456 |

*Primary Examiner*—Robert B. Reeves
*Assistant Examiner*—Joseph D. Pape
*Attorney, Agent, or Firm*—Christie, Parker & Hale

[57] ABSTRACT

A switching system for a high-speed railway system has no moving parts on the road bed, all of the switching decisions and actions being taken aboard a vehicle travelling on the system. A pair of parallel main running rails commences to diverge at the switching point, and two pairs of parallel main running rails leave the switching point. The outer rail of each pair of outgoing rails is a continuation of one of rails incoming into the switching point. A pair of switching rails is between the main rails and each is parallel to the opposite continuing rail. The truck on a vehicle on the rail system has flange running wheels which engage the main rails. A pair of wide switching wheels has flanges closer together than the flanges on the running wheels. The switching wheels can be shifted laterally so that the flange on one of the switching wheels engages a switching rail and guides the vehicle toward the pair of main rails parallel therewith. Preferably the switching rails have a central portion at a higher elevation than the adjacent main rails for lifting the running wheels off the main rails through the switching point.

13 Claims, 2 Drawing Sheets

PASSIVE RAILWAY SWITCHING SYSTEM

BACKGROUND OF THE INVENTION

This application is a division of application Ser. No. 835,974, filed Mar. 4, 1986, now abandoned, which was in turn a continuation-in-part of application Ser. No. 513,009, filed Jul. 12, 1983, also abandoned. The subject matter of these earlier applications is hereby incorporated by reference.

FIELD OF THE INVENTION

This invention relates to a railway switching system in which the rails of the switch remain in a stationary position and the direction taken by each vehicle traveling on the rails is determined by the shifting of certain components contained within the vehicle itself. More particularly, it relates to such a "passive" switching system wherein the vehicle undergoes no sudden change in either speed or direction and the wheels supporting the vehicle travel through the switch along a smooth, continuous path involving no abrupt change in either rotational speed or direction. Because of the smooth operation of the system, it is suitable for high-speed, high-load, and high-capacity railway systems. The system described consists of stationary rails extending through the switching point, movable switching wheels attached to the vehicles riding on the rails, and means for shifting the movable switching wheels.

DESCRIPTION OF THE PRIOR ART

Passive railway switches, wherein the rails at the switching point remain in a stationary position and the vehicles traveling on the rails possess mechanisms which determine the direction of travel at the switch are known in the art. The primary purpose of such devices is to allow consecutive vehicles traveling on a railway system to travel in different directions at a switch without the need for providing sufficient space and time between the consecutive vehicles to allow the shifting of the switching rails between the passage of the vehicles. This allows the consecutive vehicles to travel in closer proximity to one another and thus increases the traffic capacity of the railway system.

The prior inventions cited above can be divided into two types: those which forcibly direct the vehicle into an abrupt change of direction, and those which employ the flange (or some other appurtenance) of a wheel as a temporary support for the weight of the vehicle. Both types possess serious drawbacks which make them unsuitable for high-speed railway systems.

Any abrupt change in the direction of a vehicle results in the introduction of increased stress, both to the mating parts which directly absorb the force causing the change in direction, and to all other components of the vehicle or articles contained within the vehicle. For passenger vehicles, these stresses are translated into discomfort for the passengers. These stresses increase with increasing speed of travel, thus tending to limit the speed of travel on systems employing such switching systems.

The flange of a railroad wheel travels at a higher peripheral speed than does the normal running surface of the wheel. Therefore, when the flange is brought into play as a temporary support surface, there is a significant velocity difference between the flange and the stationary running surface upon which it rides. As the flange comes into contact with the stationary running surface, sliding friction between the two surfaces results in the introduction of a number of undesirable effects, as follows:

1. Abrupt deceleration of the rotation of the wheel at the beginning of the switching point and similar abrupt acceleration at the end;

2. High stresses in the wheel and in components supporting the wheel as a result of such accelerations;

3. Excessive wear of the running surfaces of both the wheel flange and the stationary platform upon which it rides; and 4. The generation of noise as the two parts slide against each other.

In addition to these drawbacks, the width of wheel flanges is generally less than that of normal wheel running surfaces, thus resulting in an even further increase in both stress and wear. Moreover, all of these effects increase greatly with increasing speeds of travel. As a result, the use of such switching systems is severely limited in high-speed, high-load, or high-traffic railway systems.

SUMMARY OF THE INVENTION

The present invention provides a passive railway switching system wherein the vehicles traveling on the railway system undergo no change in velocity at a switching point other than that encountered at any normal curve in the track of the system; the wheels supporting the vehicles through the switch undergo no change in rotational velocity; no sliding friction between wheels and stationary support surfaces is encountered; and the running surfaces of both wheels and rails through the switch are identical in design to those used elsewhere on the railway system. This invention assures smooth and quiet operation of all components of the railway system through a switch, and permits the use of passive switches over any range of velocity, load, or traffic volume of which the railway system itself is capable.

The system consists of stationary switches comprising normal rails leading off into two alternative directions, plus auxiliary switching rails which support the vehicles only through the switches; special switching wheels mounted on the vehicles using the system, the switching wheels being separate from the normal running wheels of the vehicles; and means for shifting the switching wheels from one position to another in such a way that the position of the switching wheels determines the direction taken by the vehicle at each switch.

In the preferred embodiment, each switch is symmetrical about the track leading into it; that is, each of the two alternative tracks leading away from the original track deviates equally in direction from the original track. Each of these two alternative tracks is also banked in such a way that its superelevation matches the normal speed of travel of vehicles using the railway system.

In the preferred embodiment, a pair of switching wheels is mounted on each wheel truck of a vehicle using the system such that the switching wheels normally run under a light load in contact with the rails of the railway system; this keeps them turning at a normal speed of rotation at all times. Each pair of switching wheels is capable of lateral motion which is limited in such a way that the wheels become locked either in an extreme left or extreme right position. Shifting of the wheel pairs from one position to the other is accomplished by means of solenoids or other devices.

It is an object of this invention to provide a passive switching system which is capable of being used on high-speed railway systems in order to increase the traffic capacity of the railway systems.

Another object is to assure that each switching operation takes place smoothly and quietly in order to maximize the comfort of passengers traveling on the railway system.

A further object is to assure long life of the system by minimizing wear on both the moving and stationary components of the switching system.

These and other objects of the present invention will become apparent to those skilled in the art from the following detailed description, showing the contemplated novel construction, combination, and arrangement of parts as herein described, and more particularly defined by the appended claims, it being understood that changes in the precise embodiments of the herein disclosed invention are meant to be included as come within the scope of the claims, except insofar as precluded by the prior art.

BRIEF DESCRIPTION OF THE DRAWINGS

The preferred embodiment of the present invention is illustrated in the accompanying drawings, in which.

DETAILED DESCRIPTION OF THE INVENTION

Figure 1:
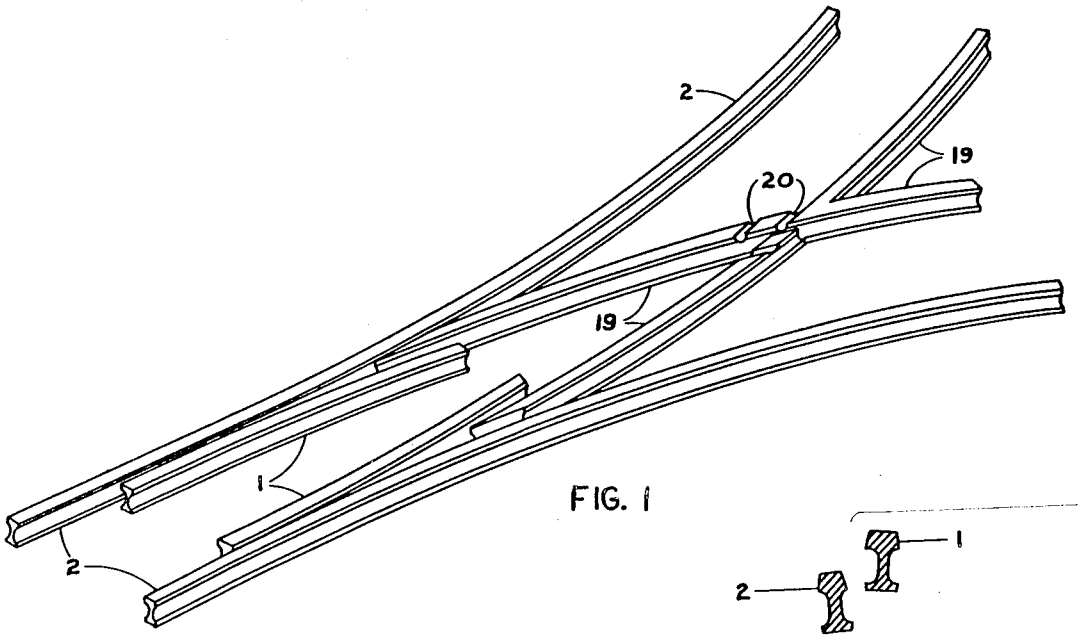
FIG. 1 is a perspective diagrammatic representation of the switching rails of the present invention at a switching point.
Figure 2:
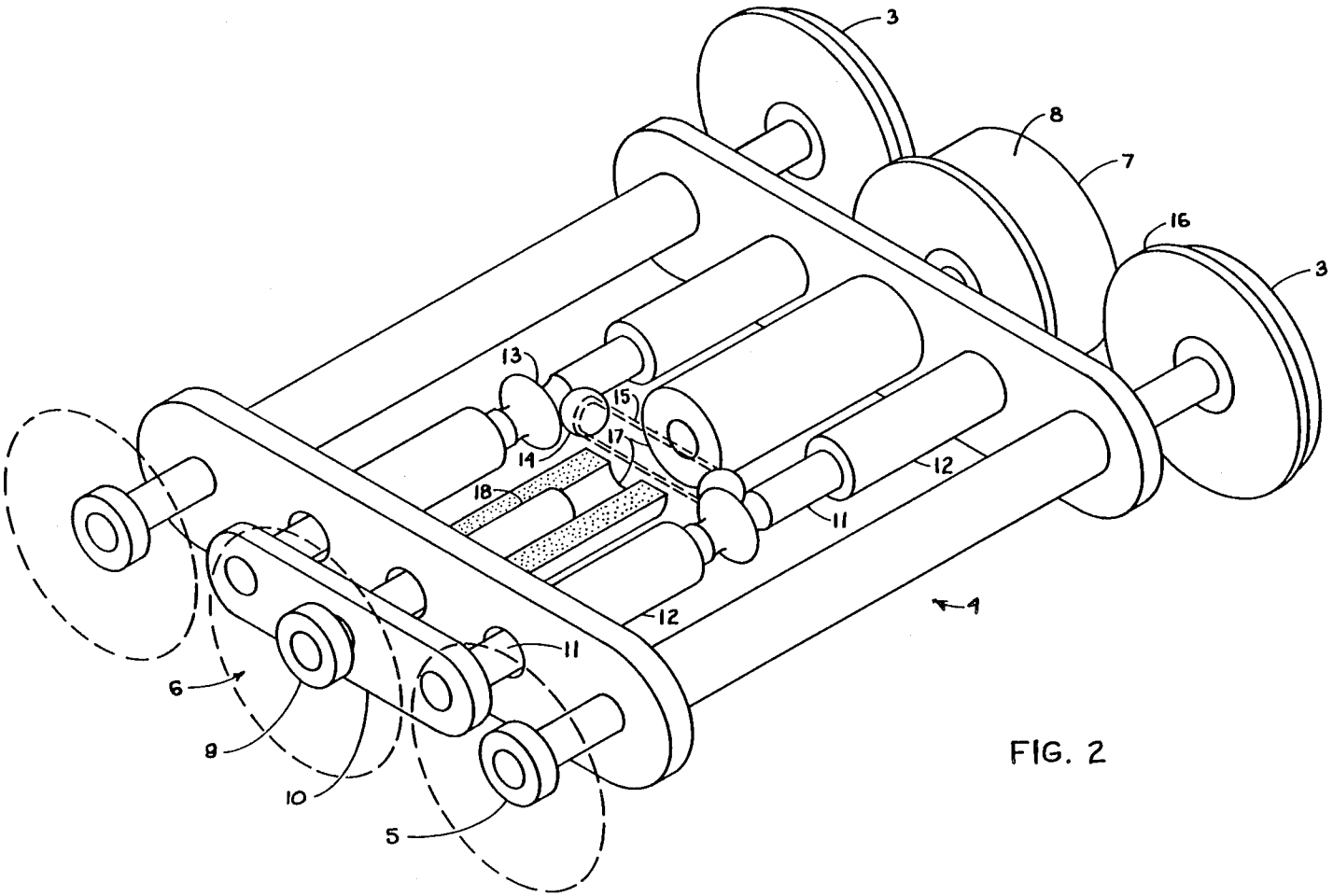
FIG. 2 is a detailed cutaway view of one wheel truck of a vehicle using the system, showing details of the switching wheels and the mechanism used to shift the switching wheels from one position to the other.

A schematic layout of a typical switch is shown in FIG. 1. In this drawing curvatures are exaggerated and distances foreshortened for purposes of illustration. Two switching rails 1 are installed, commencing just uptrack from the point where the two main rails 2 begin to diverge from one another, thus defining the divergent paths to be followed by vehicles entering the switching point. A switching rail 1 is located just inside each of the two main rails 2, with just sufficient clearance between the main rail and switching rail for the flanges of the running wheels 3 (FIG. 2). Each switching rail then parallels the curvature of the main rail on the opposite side of the track. The tracks at switching points are banked to conform to the radius of curvature of the track at that point; thus each switching rail begins to rise above its adjacent main rail.

Referring to FIG. 2, each truck 4 of a vehicle running on the main rails 2 of the system is equipped with four running wheels 3 mounted on conventional bearings 5. Also attached to each truck, but operating independently of the running wheels is a switching wheel assembly 6. Each switching wheel assembly includes a pair of transversely opposed switching wheels 7 (the one on the near side shown only in phantom), which are similar to running wheels 3 except that they have wider running surfaces 8 than do the running wheels. The switching wheels 7 on each truck are mounted by means of bearings 9 on brackets 10, which are connected to each other by two hardened steel shafts 11 supported by ball bushings 12. This allows the entire switching wheel assembly to slide laterally. The switching wheel assembly is kept in either a far right or far left position, except when it is actually being shifted from one of these positions to the other, by means of a ring-and-groove geometry 13 located at the center of each shaft 11. Ball detents 14, pressing against the ring-and-groove and held in place by a spring 15, are located in the center of each truck by a suitable tubular case (omitted for clarity). The ball detents 14 keep the shafts 11 from remaining in any position except at either one of the extremes.

The switching wheels 7 are mounted in such a way that they normally ride slightly higher than the running wheels 3, but the running surface 8 on a wheel always rests lightly on a rail, so that it is kept rotating at running speed when the vehicle is in motion. The lateral separation between the flanges on paired switching wheels is less than the lateral separation between the flanges on paired running wheels by an amount slightly greater than the combined width of one rail plus a wheel flange 16. Thus, with the switching wheel assembly located in a normal extreme right or extreme left position, the flange of only one switching wheel is actually aligned with the flange of the adjacent running wheel on its rail at any time. However, as noted above, the opposite switching wheel on the same switching wheel assembly is kept rotating by virtue of the fact that the greater width of its running surface keeps it in light contact with its associated rail, even though it is not actually in line with that rail.

Lateral right or left movement of a switching wheel assembly is provided by means of solenoids 17 surrounding soft iron cores 18, which are also attached to the brackets 10. Each solenoid is powerful enough by itself to overcome the resistance of the spring 15 plus friction between the wheels and rails, and thus to shift the entire switching wheel assembly and its associated switching wheels to the left or right. However, two solenoids 17 are provided for reliability and safety.

Figure 3:
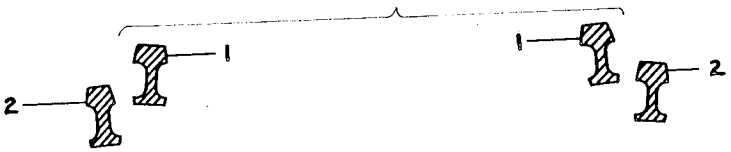
FIG. 3 is a cross-section of the rails at a switching point, showing the superelevation of the rails.

The lateral position of the switching wheel assembly determines the direction that a vehicle follows at each switching point. Referring again to FIG. 1, as a vehicle approaches each switch, its switching wheel assemblies 6 are shifted toward the direction of travel to be followed at the upcoming switch. This brings the switching wheels 7 on the side of the vehicle opposite the chosen direction into alignment with the switching rail 1 on that side. In other words, the flanges of the switching wheel and the running wheels on the chosen side are in alignment. The flanges on these wheels pass outwardly from the switching rail on that side when the vehicle is passing through the switch. When the switching wheels on the other side come into contact with the switching rail, they are pushed upward due to the superelevation of the switching rail, as shown in FIG. 3, and assume the weight of that side of the vehicle as it turns toward the chosen direction. The running wheels on the non-chosen side are momentarily lifted off their corresponding main rail. The flange on that switching wheel follows the edge of the switching rail and assures that the vehicle follows the appropriate pair of rails.

At the first point downtrack where space permits, a new main rail 19 commences, running parallel to the switching rail on that side and spaced outwardly from it by the same distance as that between the uptrack end of the switching rail and its adjacent main rail. At the first point downtrack where the new main rail 19 has reached sufficient width to support the weight of the vehicle through the running wheels, the support offered by the switching rail is no longer needed, and the switching rail gradually loses elevation relative to the new adjacent main rail and is terminated. Further downtrack the two new main rails 19 tending in opposite directions cross each other. On either side of this intersection, grooves 20 are cut into the upper portions of the new main rails to provide clearance for the flanges 16 of the running wheels and switching wheels, more or less as in a conventional frog.

Although described with superelevation of the switching rails relative to the adjacent main rails, it will be noted that the shifting can be accomplished with the rails all at about the same elevation. The flange on the switching wheel against the flange engaging inner side of the switching rail will cause the vehicle to follow the continuing main rail on the opposite side of the track. When the switching rail ends, the flange on the running wheel engaging the inner face of the new main rail provides guidance. This arrangement causes some sliding of one set of running wheels on the diverging main rail, hence some elevation difference is preferred.

Figure 4:
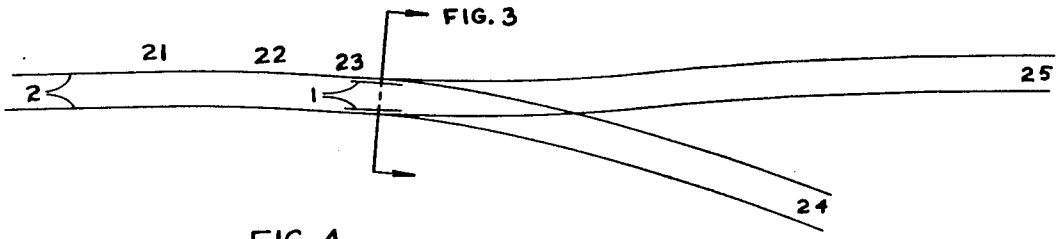
FIG. 4 is a plan view of a switch, showing the symmetry of the rails.

FIG. 4 is a plan drawing of the most common type of switch, where one track continues in a straight line and the other turns off to one side. At point 21 the track, consisting of two main rails 2, enter a standard banked curve in the direction to be taken by the switched track 24. Both the curvature and the superelevation of the track are reversed at point 22 until a level, straight geometry is once again achieved at point 23, where the switch of FIG. 1 begins. At this point 23, the switched track 24 once again begins to diverge in the selected direction, with banking commensurate with the curvature. At the same point 23 the other track 25, which will continue in the original direction, begins to curve equally in the opposite direction. After the two tracks have separated, as in FIG. 1, each track then curves and flattens into its normal course. In the case of railway systems designed for relatively high speeds, both the curvature of the tracks and their superelevations are very slight, and the effects of the various curves associated with a switch would be barely perceptible to passengers riding on the system.

The purpose of such a symmetrical switch is to assure that both renewed main rails 19, when they meet at point 20, are at the same elevation, and thus neither of them has to be cut out to provide clearance for the other. This results in a smoother ride for all vehicles entering the switch, regardless of the direction taken.

Thus, the switch is completely passive and the switching function is controlled from within the vehicle travelling in the system. Control is by shifting the switching wheels from side to side to engage one or the other of the elevated switching rails. The applicable switching wheel gradually rides up onto the switching rail, lifting its associated running wheel off of the main rail. The switching rail guides the vehicle in the desired direction, and when clear of the other main rail, the switching rail and new main rail are brought back to the same elevation and weight of the vehicle is again borne by the running wheels.

For railway systems where vehicles travel at variable speeds, the degree of superelevation employed at each switch, as at all other curved sections of track along the railway, should be commensurate with the normal speed of travel at the switch. For railway systems where vehicles travel at a constant speed, such as those powered by linear synchronous motors, the degree of superelevation at each switch could be precisely commensurate with the constant speed of travel, thus completely eliminating any lateral forces applied to vehicles at a switch. In either case, the maximum speed of travel at a switch is equal to the maximum speed of travel allowed at any other point along the railway system.

The switch has been described in the context of a vehicle entering from an incoming pair of running rails and leaving the switching point on either of a pair of outgoing rails. It will be apparent that the switch works equally well when two tracks are merging into a single track. Preferably, the switching wheels are shifted in the direction of the merging rail so that the vehicle passes through the switching point with appropriate superelevation.

Although described in a preferred embodiment, variations will be apparent to one skilled in the art. For example, instead of raising the elevation of the switching rail the full height to effect switching, a combination of lowering the main rail and raising the switching rail may be used. By lowering the main rail a smoother transition may be feasible in some switches. One mechanism for shifting the switching wheels from side to side has been described and illustrated. It will be apparent that other mechanisms, such as hydraulic actuators, may be used instead.

An embodiment has been described with two switching rails so that the vehicle can be shifted to either of two tracks symmetrically diverging from each other. Alternatively, one set of rails may continue more or less straight through the switching point without an elevated switching rail. One side of the track may be provided with an elevated switching rail which can be used to switch the vehicle toward the opposite pair of running rails. Control remains by shifting the switching wheels from side to side, however, in one direction there is no engagement with a switching rail and the vehicle proceeds in a more or less straight path, and in the opposite direction, a switching wheel engages the switching rail.

Many other modifications and variations will be apparent and it is therefore to be understood that this invention may be practiced otherwise than as specifically described.

What is claimed is:

1. A passive railway switching system for directing the wheels of a railway car in either of two directions comprising:

a pair of substantially parallel main rails which begin to diverge at a switching point, with each such main rail becoming the outside rail of a new pair of substantially parallel main rails leading in each of two directions that can be chosen for travel at the switching point;

a pair of stationary switching rails, each of which commences approximately at the point where the main rails begin to diverge, is adjacent to and offset inboard of one of the main rails by an amount adequate to allow passage of railway car wheels riding on the main rail, thence follows a path which is substantially parallel to the diverging main rail on the opposite side of the track, and continues to at least a point where space permits the commencement of the other member of the new pair of main rails, the new rail being substantially parallel to and spaced from the original main rail leading in the same direction as the switching rail by the same spacing as that between the original main rails remote from the switching point; and one or more pairs of laterally movable switching wheels mounted on each vehicle traveling on the railway switching system, the switching wheels having a lateral spacing which is less than that of the main rails, and the switching wheels having running surfaces which are wide enough that at least one of the switching wheels remains in contact with a main rail regardless of the lateral position of the switching wheels;

said components being arranged and used in combination in such a way that:

the lateral position of the switching wheels determines the direction of travel taken by the vehicle at the switching point by determining which of the stationary switching rails is engaged by the switching wheels;

the main rails and switching rails are aligned such that the vehicle proceeds through the switching point without undergoing any greater change of direction, either vertically or horizontally, than is encountered along other curves of the railway system where the switching system is used, having the same curvature as the rails through the switching point; and the main rails and switching rails are aligned such that the switching wheels proceed through the switching point, supported in turn by the main rails, the switching rails, and the new main rails without undergoing any substantial change in rotational velocity.

2. The railway switching system of claim 1 wherein the bearing surfaces of the switching rails and the switching wheels possess load-carrying capacities which are substantially equal to or greater than the load-carrying capacities of the rails and wheels employed during travel on other portions of the railway system.

3. The railway switching system of claim 1 wherein each of the switching rails is sufficiently superelevated above its corresponding main rail to provide stable travel of vehicles using the railway system.

4. The railway switching system of claim 3 in a constant-speed railway system, wherein the superelevation of the switching rails is similar to superelevation of other curved portions of the railway system.

5. The railway switching system of claim 1 wherein the geometry of the switching point is substantially symmetrical about the longitudinal axis of the track at the point where the switching point commences, thus causing the two new main rails to cross at the same elevation and precluding any need for the removal of a portion of one rail to provide clearance for the wheels of vehicles riding on the other rail.

6. The railway switching system of claim 1 wherein the switching rails each have a portion between the ends of the switching rail at a higher elevation than the adjacent main rail.

7. A passive railway switch comprising:

a pair of substantially parallel incoming main rails;

a first pair of substantially parallel outgoing main rails, one of the outgoing main rails being a continuation of one of the incoming main rails;

a second pair of substantially parallel outgoing main rails diverging from the first pair of outgoing main rails, one of the second pair of outgoing main rails being a continuation of the other of the incoming main rails;

a first switching rail parallel to one of the continuing main rails between such continuing rail and at least the other incoming main rail, and having a portion at a higher elevation than the other continuing rail;

a second switching rail parallel to the other of the continuing rails between such continuing rail and at least the one continuing main rail, and having a portion at a higher elevation than the one continuing rail; and wherein the switching rails each gradually increase in elevation above an adjacent main rail to a maximum elevation and gradually decrease in elevation toward an adjacent main rail so that a wheel rolls smoothly from an adjacent main rail onto the switching rail and back again to an adjacent main rail.

8. A truck for a railway vehicle comprising:

at least a pair of flange running wheels for engaging each of a pair of running rails;

at least a pair of flange switching wheels, the flanges on the switching wheels being closer together than the flanges on the running wheels;

means for shifting the switching wheels laterally between two extreme positions adjacent to one or the other of the running wheels; and wherein each of the switching wheels has a running surface wider than the running surface on the adjacent running wheel.

9. A truck as recited in claim 8 further comprising means for latching the switching wheels in either of the extreme positions.

10. A passive railway switching system comprising:

a pair of substantially parallel incoming main rails which begin to diverge at a switching point;

a first pair of substantially parallel main rails outgoing from the switching point, one of the incoming main rails becoming the outside rail of the first pair of outgoing main rails;

a second pair of substantially parallel main rails outgoing from the switching point, one of the incoming main rails becoming the outside rail of the second pair of outgoing main rails;

a pair of stationary switching rails offset inboard of the main rails by an amount sufficient to allow passage of the flanges of railway wheels of vehicles between the main rail and the switching rail, each switching rail following a path which is substantially parallel to the opposite diverging main rail, each switching rail commencing approximately at the point where the incoming main rails begin to diverge and ending approximately where the other member of its pair of outgoing main rails is available to engage a vehicle wheel, a portion of each switching rail between its ends being at a higher elevation than the adjacent main rails;

a vehicle for travelling in the system; and at least one truck on the vehicle, each such truck comprising:

at least one pair of running wheels having flanges for engaging the insides of the main rails and running surfaces for engaging the tops of the main rails;

at least one pair of flange switching wheels, the switching wheel flanges being spaced apart laterally a distance less than the spacing of the flanges on a pair of running wheels; and means for shifting the switching wheels laterally so that the flange of only one of such a pair of switching wheels engages the side of a switching rail; and wherein the main rails and switching rails are aligned such that the switching wheels proceed through the switching point, supported in turn by the main rails, the switching rails, and the new main rails without undergoing any substantial change in rotational velocity.

11. A passive railway switching system as recited in claim 10 wherein the switching wheels having running surfaces which are wide enough that the switching wheels remain in contact with the main rails regardless of the lateral position of the switching wheels.

12. A passive railway switching system as recited in claim 10 wherein the switching rails are aligned such that the vehicle proceeds through the switching point without undergoing any greater change of direction, either vertically or horizontally, than is encountered along another curve of the railway system where the switching system is used, having the same curvature as the rails through the switching point.

13. The railway switching system of claim 1 wherein the curvature of each pair of main rails leaving the switching point is substantially the same.

* * * * *